United States Patent [19]

Hwang

[11] Patent Number: 4,514,455

[45] Date of Patent: Apr. 30, 1985

[54] NONWOVEN FABRIC FOR APPAREL INSULATING INTERLINER

[75] Inventor: Sang-Hak Hwang, Wilmington, Del.

[73] Assignee: E. I. Du Pont de Nemours and Company, Wilmington, Del.

[21] Appl. No.: 634,780

[22] Filed: Jul. 26, 1984

[51] Int. Cl.[3] ..... B32B 27/14

[52] U.S. Cl. ..... 428/198; 428/102; 428/195; 428/212; 428/219; 428/284; 428/287; 428/362; 428/398

[58] Field of Search ..... 428/102, 195, 219, 287, 428/362, 398, 284, 198, 212; 28/104

[56] References Cited

U.S. PATENT DOCUMENTS

| | | | |
|---|---|---|---|
| 3,493,462 | 2/1970 | Bunting et al. | 161/169 |
| 3,508,308 | 4/1970 | Bunting et al. | 28/72.2 |
| 3,560,326 | 2/1971 | Bunting et al. | 161/169 |
| 4,039,711 | 8/1977 | Newman | 428/287 |
| 4,187,390 | 2/1980 | Gore | 174/102 R |
| 4,304,817 | 12/1981 | Frankosky | 428/361 |

FOREIGN PATENT DOCUMENTS

| | | |
|---|---|---|
| 841938 | 5/1970 | Canada . |
| 1063252 | 3/1967 | United Kingdom . |

OTHER PUBLICATIONS

J. L. Cooper & M. J. Frankosky, "Thermal Performance of Sleeping Bags", Journal of Coated Fabrics, vol. 10, pp. 108–114, (Oct. 1980).

Thinsulate Thermal Insulation, Technical Bulletin, 3M Company.

*Primary Examiner*—James J. Bell

[57] ABSTRACT

A composite nonwoven fabric, particularly suited for an apparel insulating interliner, comprises a batt of crimped polyester staple fibers and a nonwoven sheet of continuous polyester filaments which are attached to each other by a series of parallel seams having a seam-to-seam spacing in the range of 1.7 to 5 cm. The batt is made of a particular blend of heavy and light staple fibers. The composite fabric has a density of 15 to 24 $kg/m^3$ and an insulating value of at least 7 $CLO/(kg/m^2)$.

5 Claims, 3 Drawing Figures

NONWOVEN FABRIC FOR APPAREL INSULATING INTERLINER

BACKGROUND OF THE INVENTION

1. Field of the Invention

This invention relates to a composite nonwoven fabric which is particularly suited for use as an apparel insulating interliner. More particularly, the invention concerns such a fabric which includes a batt of staple polyester fibers that is attached to a nonwoven sheet of continuous polyester filaments.

2. Description of the Prior Art

Many nonwoven materials have been suggested and used for insulating interliners. J. L. Cooper and M. J. Frankosky, "Thermal Performance of Sleeping Bags," Journal of Coated Fabrics, Volume 10, pages 108–114 (October 1980) compares the insulating value of various types of fibrous materials that have been used as interliners in sleeping bags and other articles. Among the products compared are polyester fiberfill of solid or hollow or other special fibers and a product of 3M Company (St. Paul, Minn.) called "Thinsulate." Generally, polyester fiberfill is made from crimped polyester staple fiber and is used in the form of quilted batts. Usually, batt bulk and bulk durability are maximized in order to increase the amount of thermal insulation. Hollow polyester fibers have found widespread use in such fiberfill batts because of the increased bulk they offer, as compared to solid fibers. In certain fiberfill materials such as Hollowfil ®II, a product of E. I. du Pont de Nemours and Company (Wilmington, Del.), the polyester fibers are coated with a wash-resistant silicone slickener to provide additional bulk stability and fluffability. For fiber processability and in-use bulk, slickened and non-slickened fiberfill fibers for use in garments have usually been in the range of 5 to 6 denier (5.6 to 6.7 dtex). A special fiberfill, made from a blend of slickened and non-slickened 1.5-denier polyester staple fibers and crimped polyester staple fiber having a melting point below that of the other polyester fibers, in the form of a needle-punched, heat-bonded batt, is reported to exhibit excellent thermal insulation and tactile aesthetic properties. Such fiberfill batts are also discussed in U.S. Pat. No. 4,304,817. "Thinsulate" is an insulating material in the form of a thin, relatively dense, batt of polyolefin microfibers, or of the microfibers in mixture with high denier polyester fibers. The high denier polyester fibers are present in the "Thinsulate" batts to increase the low bulk and bulk recovery provided to the batt by the microfibers alone. For use in winter sports outerwear garments, these various insulating materials are often combined with a layer of film of porous poly(-tetrafluoroethylene) polymer of the type disclosed in U.S. Pat. No. 4,187,390.

Although the above-described prior-art nonwoven materials have been useful as insulating interliners, various improvements would significantly enhance their utility. For example, needle-punched and/or bonded batts often are excessively stiff, lack conformability and sometimes require more weight than is desired for the needed insulating value. Batts containing polypropylene fibers generally cannot be dry-cleaned and, because of their low melting temperature, are difficult to laminate and often suffer damage in home-laundry dryers. Bulky batts, which are neither bonded nor needle-punched, generally lack strength, dimensional stability and resilience and are difficult to handle in cutting, lamination and other fabrication operations. Among the important characteristics desired in a material intended for use as an insulating interliner are a high insulation value per unit weight, lack of stiffness, good strength, ability to be dry-cleaned and sufficient resilience to avoid excessive crushing during lamination and use.

Though not related specifically to apparel insulating interliners, a wide variety of spunlaced nonwoven fabrics are known in the art. For example, British Pat. No. 1,063,252 and U.S. Pat. Nos. 3,493,462, 3,508,308 and 3,560,326 disclose stable, nonapertured, jet-tracked, spunlaced nonwoven fabrics of hydraulically entangled polyester fibers and filaments. Usually, the spunlaced fabrics are produced by subjecting a fibrous batt to closely spaced, high energy flux, columnar jets of water. In commercial operations, the jets are usually arranged in rows in which the number of jets per centimeter is in the range of 10 to 25. The use of widely spaced jets also has been disclosed. For example, in British Pat. No. 1,063,252, Example I describes the hydraulic stitching of a batt of polyester fibers in "quilt-like" fashion to form "seams" that are spaced ¾-inch (1.9-cm) apart in the batt and Example II describes the steaming of the stitched batt. However, neither example records detailed characteristics of the stitched batt. Applicant has found that such stitched batts are generally very weak and difficult to handle.

It is also known, though again not with respect to nonwoven fabrics for apparel insulating interliners, that various fibrous layers, such as batts, webs, scrims, sheets and papers, can be combined by means of hydraulic entanglement techniques into spunlaced nonwoven fabrics. For example, Canadian Pat. No. 841,938 discloses "laminating," by means of hydraulic entanglement, batts of staple rayon fibers, or sheets of paper (i.e., wood pulp fibers) to sheets of continuous polyester filaments. At least 10 jets per inch (4 per cm) and preferably 30 to 50 per inch (12 to 20 cm) are suggested for forming the spunlaced "laminates."

Although the known spunlaced nonwoven fabrics have found wide application in many end uses, none of the spunlaced fabrics were used for apparel insulating interliners, nor would the spunlaced fabrics have adequately satisfied the technical requirements for such interliners.

It is an object of the present invention to avoid or at least significantly reduce, the shortcomings of the above-described insulating materials and to provide a new composite nonwoven fabric that is particularly suited for use as an apparel insulating interliner.

SUMMARY OF THE INVENTION

The present invention provides a composite nonwoven fabric which comprises a batt of crimped polyester staple fibers and a bonded sheet of substantially continuous polyester filaments. The batt and the sheet are in surface contact with each other and are attached to each other by a series of parallel seams having a spacing of at least 1.7 cm, and preferably no greater than 5 cm, between successive seams. The staple fiber batt has an area weight in the range of 100 to 250 grams/square meter and contains a blend of light and heavy fibers. The heavier fibers have a dtex which is no greater than 20 and is at least twice, but no greater than 15 times, that of the dtex of the lighter fibers. The lighter fibers have a dtex in the range of 1 to 3 and amount to 40 to 85 percent of the batt weight. The bonded filament sheet has an area weight in the range of 10 to 25 grams/square meter. The composite nonwoven fabric has an average density in the range of 15 to 24 kilograms/cubic meter and a thermal insulation value per unit weight of at least 7 CLO per kg/m$^2$.

In a preferred embodiment of the invention, the seams are jet tracks which are a result of hydraulic stitching.

In another preferred embodiment of the composite nonwoven fabric of the invention, the staple fiber batt weighs no more than 150 g/m$^2$ and includes at least 20% by weight of hollow fibers, the dtex of the heavier fibers is at least five times the dtex of the lighter fibers, the lighter fibers amount to 50 to 80 percent of the fabric weight and the nonwoven fabric has an average density of no greater than 20 kg/m$^3$ and an insulation value of at least 9 CLO/(kg/m$^2$). In still another preferred embodiment of the invention, the spacing between the seams is in the range of 1.9 to 3.2 cm.

BRIEF DESCRIPTION OF THE DRAWINGS

The invention will be more readily understood by reference to the drawings wherein insulation value, density and strength of composite nonwoven fabrics of the invention are plotted against seam spacing in FIGS. 1, 2 and 3, respectively.

DETAILED DESCRIPTION OF PREFERRED EMBODIMENTS

Figure 1:
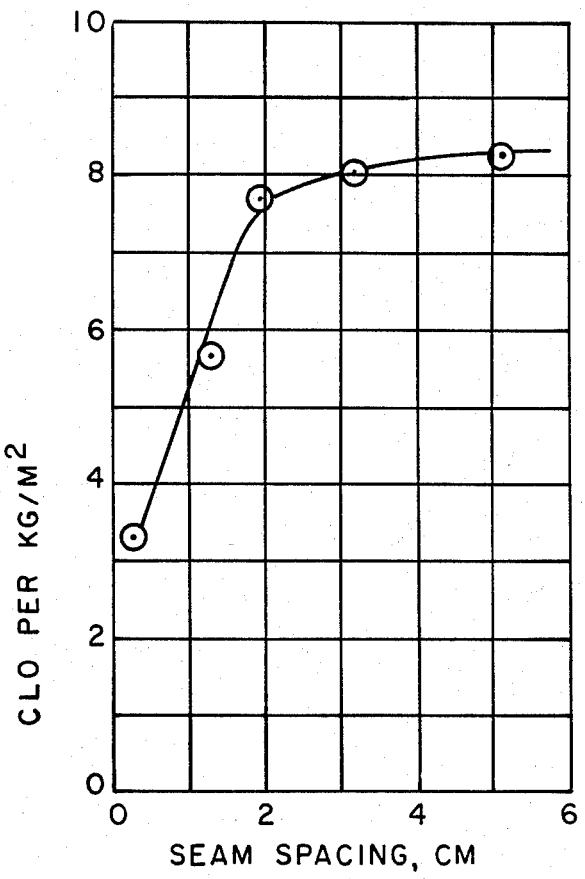

To achieve the thermal and aesthetic characteristics desired for a superior apparel insulating interliner, the composite nonwoven fabric of the present invention must be constructed in a very specific manner. Among other things, the composite nonwoven fabric must comprise a batt of a particular blend of polyester staple fibers. The batt must be attached to a nonwoven sheet of polyester continuous filaments in a particular way. The weights of the batts and sheet, the composition of the staple fiber blend, as well as the final density of the composite fabric must each be controlled to within specific limits in order to achieve the desired characteristics of the composite fabric. These specific features of the invention will be discussed in the following paragraphs and illustrated by the Examples hereinafter.

Staple fiber blends which are suitable for use in the fabric of the present invention can be prepared by any of several known methods. For example, batts may be prepared by carding and cross-lapping, by Rando-Webber techniques or by the air-laydown methods described in U.S. Pat. No. 3,797,074. Usually, the batts have an area weight in the range of 100 to 250 g/m$^2$. For lighter weight fabrics, batts of no heavier than 150 g/m$^2$ are preferred.

The staple fiber batts for use in the invention are prepared from blends of light and heavy, crimped, polyester staple fibers. The light fibers have a dtex in the range of 1 to 3 and amount to 40 to 85% by weight of the batt. Preferably, the light fibers amount to at least 50% by weight of the batt and most preferably, for an optimum combination of desired characteristics in the composite fabric, within the range of 70 to 80%. The heavy fibers have a dtex which is at least two times, but no greater than 15 times that of the light fiber. Preferably, the dtex of the heavy fibers is at least four times that of the light fibers. The maximum dtex of the heavy fibers is 20.

Generally, the crimped polyester staple fibers of the batt have crimp levels of 2 to 5 crimps/cm, but higher crimp levels also can be suitable. The staple fiber length is usually in the range of 1 to 6 cm, though somewhat longer fibers also can be satisfactory. The fibers may be solid or hollow and of substantially any cross-section.

In addition to the light and heavy staple fibers, the batt optionally may contain as much as 15 percent or more of binder fibers. Upon heat treatment at temperatures above their, melting point, the binder fibers lose their identity as fibers by coalescing on the surfaces or at the cross-overs of the other fibers to bond the batt. Bonding, though not necessary, enhances the dimensional stability of the staple fiber batt.

According to the present invention, the above-described blends of crimped, polyester staple fibers are necessary in order to impart appropriate density, thickness, resilience, hand and insulating characteristics to the composite nonwoven fabric. Within the limits prescribed for the staple fiber batts, the present inventor observed the following general effects, which explain several of the preferences stated for different features of the batts. Increase in the amount of heavy fibers or their denier usually results in composite fabrics having greater resilience and bulk. Increased fiber crimp enhances softness. Increases in the amount of hollow fiber increases bulk, decreases density and improves thermal resistance. Any decreases in batt density generally increase the thermal resistance of the composite fabric.

The composite nonwoven fabric of the present invention requires a bonded nonwoven sheet of continuous polyester filaments be attached to the staple fiber batt. The sheets have an area weight in the range 10 to 25 g/m$^2$. Such sheets, in the form of spunbonded polyester sheets, are available commercially (e.g., Reemay® spunbonded polyester, sold by E. I. du Pont de Nemours & Co.). Preferred sheets for use in the present invention contain crimped or straight, low (e.g., 2–3) dtex filaments which are somewhat randomly arranged and highly dispersed within the sheet and bonded at filament cross-overs. Prior to attachment to the staple fiber batt, the bonded continuous filament sheet may be softened, if desired, by any of several known methods, such as by impinging jets of water on the sheets, as disclosed in U.S. Pat. No. 4,329,763. The light-weight, bonded continuous filament sheet, through its strength, when attached in accordance with the present invention to the blended staple fiber batt, provides the composite fabric with strength and dimensional stability suitable for good apparel insulating interlines.

Figure 2:
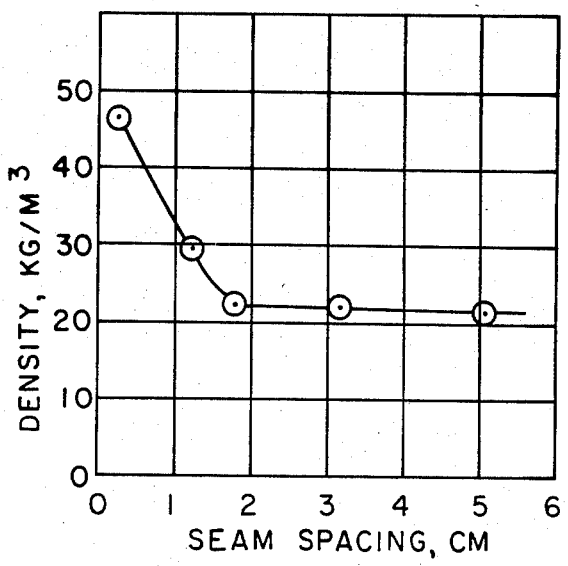

The manner in which the staple fiber batt and the nonwoven sheet are attached to each other is of great importance in achieving the required density, strength and insulation value in the composite fabric of the invention. The sheet and the batt are held in surface-to-surface contact with each other by a series of parallel seams. The seams may be in the form of jet tracks or "hydraulic stitches", lines of intermittent thermally bonded points, sewn seams, stitch-bonded seams or the like. The spacing between successive seams, according to the present invention must be no less than 1.7 cm. As shown in FIGS. 1 and 2, closer spacing of the seams in the composite fabric results in significant increases in fabric density and large reductions in insulating value. Generally, spacings of greater than 5 cm are avoided. The most preferred spacing is in the range of 1.9 to 3.2 cm. Even with such widely spaced seams, the composite fabrics constructed in accordance with the present invention, not only have satisfactory aesthetic and thermal insulating characteristics, but also have strengths that are significantly greater (e.g., by more than a factor of three) than those that would have been achieved by simply adding the strengths of the batt and sheet together. These effects are illustrated in Example III hereinafter.

A process by which a preferred composite fabric is fabricated involves the steps of (1) preparing a batt of a blend of polyester fibers in accordance with the batt requirements described above; (2) preparing a bonded sheet of continuous polyester filaments meeting the sheet requirements described above; and then (3) with the batt atop the sheet, while both are supported on a moving screen, treating the batt and sheet with columnar jets of water located in a row perpendicular to the direction of movement of the screen. The spacing between jets is arranged to provide the seam spacing desired in the resultant composite fabric. The jets are of the high impact type and are supplied through orifices of about 0.1 to 0.2 mm diameter at pressures usually in the range of 4800 to 14,000 kPa (700 to 2000 psi) from apparatus of the general type disclosed in U.S. Pat. No. 3,403,862. By comparison with conventional hydraulic entanglement processes, very little total energy per unit weight of fabic is needed to prepare hydraulically stitched composite fabrics of the present invention.

When a thermoplastic binder is present in the batt of the composite fabric, the binder preferably is activated by heating the batt after it has been stitched to the nonwoven sheet. Of course, the batt may be bonded at an earlier stage, if desired.

As a result of the manner in which the components of the composite fabric are assembled and seamed together, the fabric density can be controlled to average between 15 and 24 kg/m$^3$ and the insulating values of the fabric can be controlled to be at least about 1.6 CLO/cm and at least 7 CLO per kg/m$^2$. In preferred composite fabrics of the invention, the ingredients are selected and the process is controlled to provide composite fabrics having an average density of no greater than 20 kg/m$^3$ and a CLO/(kg/m$^2$) of at least 9.

For use as insulating interliners in winter sports outerwear garments, the composite nonwoven fabrics of the invention are often laminated by means of adhesives and/or heat and/or pressure to a poly(tetrafluoroethylene) film which is air-permeable but does not transmit liquid water. The laminating process usually reduces the thickness of the composite fabric, adds somewhat to its weight and increases its density. Nevertheless, the laminated composite fabrics still have satisfactory aesthetic characteristics and retain sufficient thermal resistance to be considered excellent materials for apparel insulating interliners.

The following test procedures are used to measure the various characteristics and properties reported herein. All measurements are made on dry fabrics or fiber.

Tensile properties are measured at 70° F. and 65% relative humidity with an Instron tester. Grab strength is measured in general accordance with ASTM Method D-1117-77, on a 4-inch (10.16-cm) wide by 6-inch (15.24-cm) long sample. A gauge length of 3 inches (7.62 cm), clamps having 1-inch (2.54-cm) wide grippers and an elongation rate of 12 inches (30.5 cm) per minute are used. The grab strength, which is measured in pounds is reported herein in Newtons. For each of the tensile measurements, samples are cut in the machine direction (MD) and in the cross-machine direction (XD). The test results recorded herein are the averages of the MD and XD measurements.

Fabric thickness is determined on a 12-inch by 12-inch (30.5×30.5 cm) fabric sample with a pantographic cantilever apparatus (e.g., such as the type sold by Certain-Teed Co.). The apparatus has two parallel plates which can be counterbalanced to zero load. For the thickness measurements reported herein a 131-gram weight was applied so that the thickness of the samples were measured under a load of 0.002 psi (0.0138 kPa). The sample is also weighed on a beam balance to determine area weight, which is reported herein in g/m$^2$. The density of the sample is then calculated from the thickness and weight measurements and is recorded herein in kg/m$^3$ for the samples under 0.002 psi (0.0138 kPa) load.

The insulating values of the composite fabrics of the invention are reported in terms of CLO, a unit of thermal resistance used in evaluating the warmth of clothing. A unit of CLO is the standard that was established to approximate the warmth of a wool business suit. However, CLO is defined in more precise technical terms as the thermal resistance which allows passage of one kilogram calorie per square meter per hour with a temperature difference of 0.18° C. between two surfaces. Thus, 1 CLO=0.18 (°C.)(m$^2$)(hr)/(kg-cal). The method of measuring CLO involves determining the thermal conductivity of the sample at the thickness obtained under a load of 0.002 psi (0.0138 kPa). The measurement is performed substantially as described on page 110 of the Cooper and Frankosky article, referred to earlier in the "Description of the Prior Art." The insulating value of the sample is then reported in CLO, CLO per unit thickness (i.e., CLO/cm) and CLO per unit weight (i.e., CLO/(kg/m$^2$).

Although the invention is illustrated in the following examples by composite fabrics whose manufacture included hyraulic stitching of the staple fiber batts to the continuous filament nonwoven sheets, other equivalent techniques of seaming can also be used to produce the composite fabrics.

EXAMPLE I

This example illustrates a preferred method by which a batt of a blend of crimped polyester staple fibers and a nonwoven sheet of polyester continuous filaments are hydraulically stitched together to form a composite nonwoven fabric of the invention that is suitable for use as an insulating interliner.

The blend of crimped polyester staple fibers that was used to form the staple fiber batt consisted of 75% by weight of light fibers and 25% by weight of heavy fibers. The light fibers were solid fibers of 1.5 dtex (1.35 dpf) and 3.2-cm length having about 3½ crimps/cm. The heavy fibers were solid fibers of 6.1 dtex (5.5 dpf) and 1.9-cm length having about 3 crimps/cm.

The nonwoven sheet of polyester continuous filaments that was used was a bonded sheet of Reemay® spunbonded polyester, Style S-2250, a product of E. I. du Pont de Nemours & Co. The sheet weighed about 19 g/m$^2$ and was composed of substantially randomly arrayed, well dispersed 2.4 dtex continuous filaments, of which 91% were of polyethylene terephthalate and 9% of polyethylene terephthalate/isophthalate (79/21) copolymer. The copolymer filaments act as binder filaments.

To assemble the nonwoven sheet with the staple fiber batt, an air-lay apparatus of the type disclosed in U.S.

Pat. No. 3,797,074 was employed. The fiber laydown section of the apparatus was arranged so that the nonwoven sheet of continuous filaments passed through the laydown zone atop the conveyer. The conveyer was a screen having 39×38 openings per linear centimeter (100×96 per inch) and operated at an exit speed of 10 meters per minute.

The staple fiber blend was carded and cross-lapped in order to form a heavy batt which was fed to the disperser roll of the air-laydown apparatus. The machine was operated so that a staple fiber batt weighing about 137 g/m$^2$ (4 oz/yd$^2$) was air-laid atop the nonwoven continuous filament sheet.

The batt and sheet, while still supported on the conveyer screen, were then forwarded at a speed of 10 m/min through two rows of columnar jets of water. Each row contained 0.4 jet/cm (one per inch). The rows of jets were aligned perpendicular to the movement of the conveyer in non-staggered arrangement (i.e., each jet in the second row was positioned directly behind the corresponding jet in the first row, so that each pair of jets formed one seam or jet track). The jets were supplied through 0.18-mm (0.007-inch) diameter orifices at a pressure of 6890 kPa (1000 psi). The resultant composite fabric was passed through squeeze rolls to remove water and then dried on drying drums operating at an average temperature of 163° C. The product was then wound up on a roll.

The resultant composite nonwoven fabric had a total area weight of 156 g/m$^2$, a thickness of 0.69 cm and a density of 22.6 kg/m$^2$. It had a measured CLO of 1.22, a CLO/cm of 1.77 and CLO/(kg./m$^2$) of 7.82. In addition to each of these desirable characteristics, the composite nonwoven fabric was judged to also possess good aesthetics (e.g., hand), thereby making the fabric well suited for use as an apparel insulating interliner material.

Various characteristics of the material prepared in this example are included in Tables I and II for the purposes of comparison with samples prepared in Example II.

EXAMPLE II

In this example, 13 samples of composite fabrics of the invention are made and their insulating characteristics evaluated. Each sample was prepared by hydraulically stitching a batt of a blend of polyester staple fibers to a bonded and softened nonwoven sheet of polyester continuous filaments. Each composite fabric had a series of parallel seams 2.54-cm (1-inch) apart.

The staple fiber batts used to make the composite fabrics of this example were prepared with a Rando-Webber. The dtex, length, crimp level and hollowness (% void) of the staple fibers making up the light fiber and heavy fiber components of each batt, as well as the weight percent of each of the batt components, are summarized in Table I.

The nonwoven sheets of polyester continuous filaments used to make the composite fabrics were of two types. One was of the same type as used in Example I, but had been softened before being attached to the staple fiber batt. The softening treatment involved passing the continuous filament nonwoven sheet twice, while supported on a screen having 16×14 openings per linear centimeter (40×36 per inch), at a speed of 9 meters/min (10 yards/min), through two rows of nonstaggered columnar jets of water supplied through 0.127-mm (0.005-inch) diameter orifices at 8268 kPa (1200 psi) pressure. The jets were evenly spaced at 15.7 per cm (40 per in) and the rows were perpendicular to the direction movement of the sheet. The orifices were located about 2.5 cm (1 inch) above the surface of the sheet. The second continuous filament nonwoven sheet was of the same weight as the first type and had the same general array of filaments except that the sheet was made in four layers containing different amounts of copolyester binder filaments. The first layer had no binder; the second and third, each had 9%; and the last layer had 12% binder filaments. This second type of bonded continuous filament nonwoven sheet was softened in the same manner as the first except that there were 23.6 jets per cm (60/in) in each row.

The staple fiber batts listed in Table I were seamed to the continuous filament nonwoven sheets by hydraulic stitching. For each sample the continuous filament sheet was placed upon a screen having 16×14 openings per linear centimeter (40×36 per inch). A staple fiber batt was placed atop the sheet. The thusly layered materials were then treated in one pass at 9 meters/min (10 yards/min) with columnar jets of water supplied through orifices of 0.127-mm (0.005-inch) diameter, located in two nonstaggered rows having 0.4 orifices per cm (1 per inch), to form hydraulically stitched composite fabrics having a series of parallel seams, with successive seams being 2.54-cm (1-in) apart. The first type of bonded and softened polyester continuous filament sheet was used with the batts listed in Table I as Samples 1, 4–7 and 10–12; the second type of sheet was used with Samples 2, 3, 8, 9 and 13. The supply pressures for the treatments were as follows: 10,340 kPa (1500 psi) for Samples 2, 3, 6, 8 and 9; 11,710 kPa (1700 psi) for Samples 1, 4, 5 and 7; 13,090 kPa (1900 psi) for Sample 12; and 13,780 kPa (2000 psi) for Samples 10, 11 and 13. After the hydraulic stitching, the resultant composite fabrics were dried in air, they were subjected to a 130° C. heat treatment for 15 minutes in a relaxed condition in a hot air oven.

The physical characteristics and the hand of the heat-treated fabrics are listed in Part A of Table II. Note that the fabrics are arranged in order of insulating value per unit area weight, from highest to lowest.

All of the samples prepared as just described, except Sample 8, were laminated to a film of amorphous poly(-tetrafluoroethylene) by means of adhesives and/or heat and/or pressure. The physical characteristics of the laminated composite fabrics are listed in Part B of Table II. As can be seen from the table, the fabrics that have high insulating values before lamination, generally have high insulating values after lamination. However, the lamination caused the insulating value per unit weight to be reduced by about 17% on the average and the thickness to be decreased by about 22%. Nonetheless, the hand of the fabrics, as well as their insulating values, were all judged suitable for use of the composite fabrics as apparel insulating interliners.

TABLE I

COMPOSITION OF BATTS OF EXAMPLES I AND II
Batt Composition, Weight %

| | Light Fibers | | | Heavy Fibers | | | |
|---|---|---|---|---|---|---|---|
| Fibers[1] | Binder | A | B | C | D | E[2] | F |
| Weight; dtex, | 6.7 | 1.4 | 1.5 | 3.3 | 6.1 | 6.1 | 16.7 |
| Length, cm | 5.1 | 3.2 | 3.2 | 3.2 | 1.9 | 5.1 | 5.1 |
| Crimp/cm | 3 | 4.7 | 3.5 | 3.1 | 3.1 | 3.5 | 2.4 |

TABLE I-continued

COMPOSITION OF BATTS OF EXAMPLES I AND II

| % Void | 0 | 32 | 0 | 0 | 0 | 16 | 16 | |
|---|---|---|---|---|---|---|---|---|
| | Batt Composition, Weight % | | | | | | | |
| Designation[3] | K-115 | — | T-106 | T-54 | T-54 | T-808 | T-76 | Wt. % light fibers in final batt |
| Sample | | | | | | | | |
| 1 | 5 | 71 | | | | 24* | | 75 |
| 2 | | 50 | | | | 25* | 25 | 50 |
| 3 | 10 | 40 | | | | 25 | 25 | 44 |
| 4 | | 75 | | | | | 25 | 75 |
| 5 | 5 | | 75 | | | 20* | | 79 |
| 6 | | 75 | | | | 25* | | 75 |
| 7 | | | 75 | | | 25 | | 75 |
| 8 | | 75 | | 25 | | | | 75 |
| 9 | 15 | 60 | | 25 | | | | 71 |
| 10 | | 75 | | | | | 25 | 75 |
| 11 | | 75 | | | | 25* | | 75 |
| Ex. I | | | 75 | | 25 | | | 75 |
| 12 | 5 | 71 | | | | 24* | | 75 |
| 13 | 10 | 40 | | 25 | | 25 | | 44 |

NOTES:

[1]With the exception of the binder fiber and Fiber A, all are commercial polyester fibers sold by E. I. du Pont de Nemours and Company. K-115 is a commercial copolyamide binder fiber, having a melting point of 115° C., sold by Mobay. Fiber A is a noncommercial fiber of annular cross-section. Hollow Fibers E and F each contain four circular holes in their cross-sections, the cross-sections being square-shaped with rounded corners.

[2]An asterisk in this column indicates that the fiber is coated with a silicone slickener.

[3]During bonding the binder fiber melts and is no longer present as a fiber in the bonded batt.

TABLE II

COMPOSITE FABRIC CHARACTERISTICS

| Sample No. | Area Weight g/m² | Thickness cm | Density kg/m² | Insulating Value in CLO per Total | cm | kg/m² | Hand |
|---|---|---|---|---|---|---|---|
| A. As Prepared | | | | | | | |
| 1 | 136 | 0.86 | 15.7 | 1.43 | 1.67 | 10.6 | 2 |
| 2 | 153 | 0.99 | 15.4 | 1.59 | 1.60 | 10.4 | 1 |
| 3 | 163 | 1.00 | 16.3 | 1.59 | 1.59 | 9.75 | 2 |
| 4 | 146 | 0.81 | 17.9 | 1.43 | 1.77 | 9.66 | 3 |
| 5 | 136 | 0.76 | 17.6 | 1.31 | 1.72 | 9.63 | 1 |
| 6 | 142 | 0.77 | 18.3 | 1.32 | 1.71 | 9.30 | 1 |
| 7 | 139 | 0.72 | 19.1 | 1.27 | 1.77 | 9.14 | 1 |
| 8 | 156 | 0.75 | 20.8 | 1.38 | 1.85 | 8.85 | — |
| 9 | 214 | 1.77 | 18.3 | 1.87 | 1.60 | 8.78 | 2 |
| 10 | 254 | 1.16 | 22.1 | 2.03 | 1.75 | 7.99 | 3 |
| 11 | 241 | 1.07 | 22.6 | 1.90 | 1.78 | 7.88 | 2 |
| Ex. I | 156 | 0.69 | 22.6 | 1.22 | 1.77 | 7.82 | 2 |
| 12 | 251 | 1.10 | 22.9 | 1.96 | 1.78 | 7.81 | 2 |
| 13 | 256 | 1.18 | 21.8 | 1.93 | 1.63 | 7.45 | 2 |
| B. After Lamination | | | | | | | |
| 1 | 152 | 0.55 | 27.7 | 0.97 | 1.77 | 7.13 | |
| 2 | 184 | 0.75 | 24.4 | 1.28 | 1.70 | 8.37 | |
| 3 | 183 | 0.79 | 23.1 | 1.29 | 1.63 | 7.91 | |
| 4 | 171 | 0.61 | 23.0 | 1.13 | 1.85 | 7.73 | |
| 5 | 176 | 0.64 | 27.9 | 1.13 | 1.77 | 8.31 | |
| 6 | 179 | 0.58 | 30.8 | 1.07 | 1.84 | 7.53 | |
| 7 | 168 | 0.60 | 28.2 | 1.09 | 1.81 | 7.54 | |
| 8 | — | — | — | — | — | — | |
| 9 | 213 | 0.81 | 26.4 | 1.39 | 1.71 | 6.49 | |
| 10 | 306 | 1.07 | 28.7 | 1.76 | 1.76 | 7.40 | |
| 11 | 322 | 0.97 | 33.5 | 1.79 | 1.85 | 7.43 | |
| 12 | 269 | 0.90 | 29.8 | 1.65 | 1.83 | 6.57 | |

TABLE II-continued

COMPOSITE FABRIC CHARACTERISTICS

| Sample No. | Area Weight g/m² | Thickness cm | Density kg/m² | Insulating Value in CLO per Total | cm | kg/m² | Hand |
|---|---|---|---|---|---|---|---|
| 13 | 296 | 1.00 | 29.5 | 1.72 | 1.72 | 6.72 | |

NOTES:

1. Example I fabric was not subjected to lamination.
2. Sample 8 was not laminated successfully.
3. The hand after lamination was rated approximately the same as before lamination. Ratings were for softness, resilience, drape: 1 = very good; 2 = good; 3 = satisfactory, but somewhat firm.
4. All CLO/(kg/m²) values are based on the area weight of the composite fabric before laminating.
5. CLO/cm values are based on the thickness before and after laminating, as the case may be.

EXAMPLE III

This example illustrates the effect of seam spacing on the insulating and strength characteristics of composite fabrics made by seaming a batt of blended polyester staple fibers to a nonwoven sheet of continuous polyester.

Five samples, Nos. 14–18, differing only in spacing between successive parallel seams were fabricated in the same manner as Sample 7 of Example II, except that the staple fiber batt weighed 115 g/m² (3.4 oz/yd²), the continuous filament sheet weighed 20 g/m² (0.6 oz/yd²), and the seam spacing for Samples 14 through 18 were, respectively, 0.25, 1.27, 1.91, 3.18 and 5.08 cm (0.1, 0.5, 0.75, 1.25 and 2 inches). Also, Sample 14 was made with only one pass through one row of jets and for Samples 15, 16 and 17 a jet orifice diameter of 0.178 mm (0.007) was employed.

Figure 3:
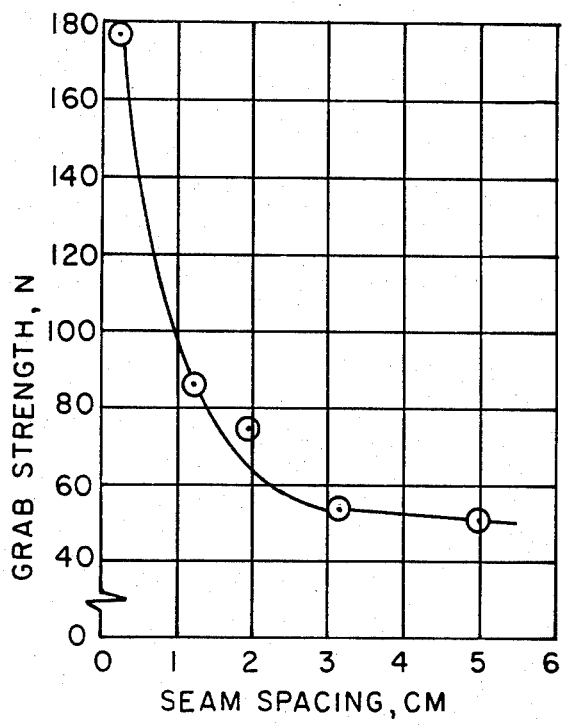

Table III summarizes the characteristics of the resultant composite fabrics and FIGS. 1, 2 and 3, respectively, graphically depict the CLO per kg/m², the density and the grab strength of the composite fabric as functions of seam spacing. Table III and the FIGS. 1 and 2 clearly show that as seam spacing is reduced below 1.7 cm, the thickness and the insulation value of the composite fabric in CLO per kg/m² decrease precipitously and the density rises very rapidly. However, the data also show that as seam spacing is increased above 1.7 cm, the insulation value and density do not change significantly, but remain at values that are highly desirable for apparel insulating interliners. FIG. 3 shows that the strength of the fabric rapidly decreases as seam spacing is increased to 1.7-cm but that the strength remains fairly constant with further increases in seam spacing. However, note that the strength of the composite fabric made at spacings of 1.7 cm or greater is still about three times the strength of the sum of the strengths of the batt and sheet before the hydraulic stitching.

TABLE III

Effect of Composite Fabric Seam Spacing

| Sample No. | 14 | 15 | 16 | 17 | 18 |
|---|---|---|---|---|---|
| Seam Spacing, cm | 0.25 | 1.27 | 1.91 | 3.18 | 5.08 |
| Thickness, cm | 0.29 | 0.46 | 0.60 | 0.61 | 0.62 |
| Density, kg/m³ | 47 | 30 | 23 | 22 | 22 |
| Grab Strength*, N | 177 | 86 | 74 | 53 | 51 |
| CLO | 0.45 | 0.76 | 1.04 | 1.08 | 1.11 |
| CLO/cm | 1.56 | 1.66 | 1.74 | 1.77 | 1.79 |

TABLE III-continued

| Effect of Composite Fabric Seam Spacing | | | | | |
|---|---|---|---|---|---|
| Sample No. | 14 | 15 | 16 | 17 | 18 |
| CLO/(kg/m$^2$) | 3.33 | 5.63 | 7.70 | 8.00 | 8.22 |

*Staple fiber batt grab strength = 0.15 Newtons Continuous filament sheet grab strength = 18 Newtons

I claim:

1. A composite nonwoven fabric comprising a batt of crimped polyester staple fibers and a bonded nonwoven sheet of continuous polyester filaments, the batt and the sheet being in surface contact with each other and being attached to each other by a series of parallel seams having a spacing of at least 1.7 cm between successive seams, the staple fiber batt weighing in the range of 100 to 250 g/m$^2$ and containing a blend of light and heavy fibers, the heavier fibers having a dtex no greater than 20 and being at least twice but no greater than 15 times the dtex of the lighter fibers and the lighter fibers having a dtex in the range of 1 to 3 and amounting to 40 to 85 percent of the batt weight, the filament sheet weighing in the range of 10 to 25 g/m$^2$, and the nonwoven fabric having an average density in the range of 15 to 24 kg/m$^3$ and a thermal insulation value per unit weight of at least 7 CLO per kg/m$^2$.

2. A composite nonwoven fabric of claim 1 wherein the seam spacing is no greater than 5 cm, the staple fiber batt weighs no more than 150 g/m$^2$ and includes at least 20 percent by weight of hollow fiber, the dtex of the heavier fibers is at least 5 times the dtex of the lighter fibers, the lighter fibers amounting to 50 to 80 percent of the batt weight and the nonwoven fabric having an average density of no greater than 20 kg/m$^3$ and a CLO/(kg/m$^2$) of at least 9.

3. A composite nonwoven fabric of claim 1 or 2 which contains no more than 15% of a binder.

4. A composite nonwoven fabric of claim 1, 2 or 3 wherein the spacing between seams is in the range of 1.9 to 3.2 cm.

5. A composite nonwoven fabric of any preceding claim wherein the seams are hydraulic jet tracks.

* * * * *